US009624712B2

(12) United States Patent
Bottin

(10) Patent No.: US 9,624,712 B2
(45) Date of Patent: Apr. 18, 2017

(54) INTERLOCKING DOOR FRAME AND WALL PANELS FOR MODULAR BUILDING UNITS

(71) Applicant: Herve Bottin, La Baule (FR)

(72) Inventor: Herve Bottin, La Baule (FR)

(73) Assignee: WILLIAMS SCOTSMAN, INC., Baltimore, MD (US)

( * ) Notice: Subject to any disclaimer, the term of this patent is extended or adjusted under 35 U.S.C. 154(b) by 0 days.

(21) Appl. No.: 14/802,093

(22) Filed: Jul. 17, 2015

(65) Prior Publication Data

US 2016/0017653 A1 Jan. 21, 2016

Related U.S. Application Data

(60) Provisional application No. 62/026,294, filed on Jul. 18, 2014.

(51) Int. Cl.
*E04B 2/00* (2006.01)
*E06B 1/52* (2006.01)
(Continued)

(52) U.S. Cl.
CPC ..... *E06B 1/52* (2013.01); *E04B 1/3483* (2013.01); *E04B 2/56* (2013.01); *E04H 1/005* (2013.01);
(Continued)

(58) Field of Classification Search
CPC ..... E06B 1/52; E06B 1/60; E06B 1/04; E06B 1/18; E06B 1/6007; E04H 1/005;
(Continued)

(56) References Cited

U.S. PATENT DOCUMENTS 3,386,218 A 6/1968 Scott
3,485,405 A * 12/1969 Dement ..... B65D 9/32 217/65
(Continued)

FOREIGN PATENT DOCUMENTS

DE 19615447 11/1996
EP 1312729 5/2003
(Continued)

OTHER PUBLICATIONS

Portafab. "OmniFlex 300" http://www.portafab.com/omniflex-300.html Mar. 30, 2015.
(Continued)

*Primary Examiner* — Beth Stephan
(74) *Attorney, Agent, or Firm* — Whiteford, Taylor & Preston, LLP; Gregory M. Stone

(57) ABSTRACT

Disclosed is a system of interlocking door frame and wall panels for modular building units. Both the door frame panel and the wall panels are provided for easy installation into the skeletal frame of the modular building unit, and are provided with mating male and female connecting edges on opposite sides of each panel. This allows the door frame panel to mate with an adjacent wall panel in the same manner in which adjacent wall panels mate with one another, ensuring a clean, finished appearance for the connecting edges, a strong, reinforced frame having long durability, and a connection having the same physical, structural integrity as the connections between adjacent wall panel units. The door frame panel itself is particularly configured to receive a traditional, commercially available steel door frame and door assembly, but allows fitment of such commercially available steel door frame and door assembly without cutting a wall panel to receive that frame.

17 Claims, 11 Drawing Sheets

(51) Int. Cl.

| | |
|---|---|
| ***E04H 1/00*** | (2006.01) |
| ***E06B 1/60*** | (2006.01) |
| ***E04B 2/56*** | (2006.01) |
| ***E04B 1/348*** | (2006.01) |
| ***E06B 1/18*** | (2006.01) |
| *E04B 1/14* | (2006.01) |

(52) U.S. Cl.
CPC ..... *E06B 1/18* (2013.01); *E06B 1/60* (2013.01); *E06B 1/6007* (2013.01); *E04B 1/14* (2013.01)

(58) Field of Classification Search
CPC ... E04H 2001/1283; E04H 15/34; E04B 2/56; E04B 1/3483; E04B 1/14
See application file for complete search history.

(56) References Cited

U.S. PATENT DOCUMENTS

| | | | | |
|---|---|---|---|---|
| 3,800,489 | A | 4/1974 | Boice | |
| 3,821,868 | A * | 7/1974 | Edwards | E04B 1/24 52/241 |
| 3,952,462 | A | 4/1976 | Heise | |
| 4,018,020 | A | 4/1977 | Sauer et al. | |
| 4,071,984 | A | 2/1978 | Larrow | |
| 4,196,555 | A | 4/1980 | Henges, Jr. et al. | |
| 4,261,150 | A | 4/1981 | Sartorio | |
| 4,644,708 | A | 2/1987 | Baudot et al. | |
| 4,748,790 | A | 6/1988 | Frangolacci | |
| 5,070,667 | A * | 12/1991 | Schulte | E04B 1/34321 52/241 |
| 5,072,554 | A | 12/1991 | Hayman | |
| 5,337,535 | A | 8/1994 | Maupin | |
| 5,519,971 | A * | 5/1996 | Ramirez | E04C 2/52 52/220.2 |
| 6,006,480 | A * | 12/1999 | Rook | E04C 2/2885 52/270 |
| 6,434,890 | B1 * | 8/2002 | Konnerth | E04B 2/7401 52/169.5 |
| 6,502,357 | B1 * | 1/2003 | Stuthman | E04B 2/7448 52/239 |
| 6,834,468 | B1 | 12/2004 | Kroie | |
| 8,033,065 | B2 | 10/2011 | Paetkau et al. | |
| 8,146,314 | B2 | 4/2012 | Nguyen | |
| 8,353,131 | B2 | 1/2013 | Freet | |
| 8,769,898 | B2 | 7/2014 | Carolan et al. | |
| 8,869,492 | B2 | 10/2014 | Leahy | |
| 8,950,132 | B2 | 2/2015 | Collins et al. | |
| 8,973,337 | B2 | 3/2015 | Hires et al. | |
| 2007/0271857 | A1 * | 11/2007 | Heather | B65D 88/005 52/79.9 |
| 2008/0134589 | A1 * | 6/2008 | Abrams | E04B 1/003 52/79.1 |
| 2008/0307739 | A1 * | 12/2008 | Clucas | E04B 1/14 52/580 |
| 2009/0165401 | A1 | 7/2009 | Smalley, III | |
| 2009/0193735 | A1 * | 8/2009 | Kalinowski | E04B 2/60 52/281 |
| 2011/0162293 | A1 * | 7/2011 | Levy | E04B 1/3483 52/79.9 |
| 2011/0173925 | A1 * | 7/2011 | Brown | E04B 1/14 52/794.1 |
| 2012/0180403 | A1 * | 7/2012 | Kull | F21K 9/30 52/79.1 |
| 2013/0305648 | A1 * | 11/2013 | Spear | E04F 13/0894 52/588.1 |

FOREIGN PATENT DOCUMENTS

| | | | | |
|---|---|---|---|---|
| FI | 1426518 | A1 * | 6/2004 | E04C 2/292 |
| GB | 1312729 | A1 * | 5/2003 | E04B 1/3483 |

OTHER PUBLICATIONS

Extrutech. "Clean Room and Room Enclosure Applications" http://www.epiplastics.com/cleanrooms.html Mar. 30, 2015.
Bally. "Modular Insulated Buildings" http://www.bmil.com/bally/modular.htm Mar. 30, 2015.

* cited by examiner

INTERLOCKING DOOR FRAME AND WALL PANELS FOR MODULAR BUILDING UNITS

CROSS REFERENCE TO RELATED APPLICATION

This application is based upon and claims benefit of copending U.S. Provisional Patent Application Ser. No. 62/026,294 entitled "MONOBLOC DOOR FRAME FOR MODULAR BUILDING UNITS," filed with the U.S. Patent and Trademark Office on Jul. 18, 2014 by the inventor herein, the specification of which is incorporated herein by reference in its entirety.

FIELD OF THE INVENTION

This invention relates generally to modular building construction, and more particularly to a system of interlocking door frame and wall panels in a modular building unit.

BACKGROUND OF THE INVENTION

Modular buildings typically comprise a skeletal metal (e.g., steel) frame that supports a number of elements allowing easy transportation, construction, and customization of the building unit. Those elements typically include a solid roof and floor and wall panels that are inserted into the frame. In order to provide access into the building unit, a door is typically provided on at least one of the walls of the building unit. However, installation of standard door assemblies into the modular assembly of a typical modular building unit has required that wall panels of the modular building unit be cut to receive a standard steel door frame. This often results in an unclean, unfinished appearance, a weak frame with low durability, and likewise often leaves gaps through which air will pass, making heating and cooling more difficult than if a properly sealed assembly were provided. An alternative is installation of a non-standard, custom door assembly that requires an expensive and complex aluminum design, requiring significant tooling investment and providing no flexibility.

Thus, there remains a need in the art for a modular building unit construction that allows fitment of a traditional door assembly, including a supporting door frame, that may be easily integrated with the modular wall panels of the modular building unit in a configuration that provides a more finished and clean appearance than previously known assemblies, and that provides a structurally reinforced frame, all while maintaining ease of transportability, installation, and customization of the modular building unit.

SUMMARY OF THE INVENTION

Disclosed is a system of interlocking door frame and wall panels for modular building units. Both the door frame panel and the wall panels are provided for easy installation into the skeletal frame of the modular building unit, and are provided with mating male and female connecting edges on opposite sides of each panel. This allows the door frame panel to mate with an adjacent wall panel in the same manner in which adjacent wall panels mate with one another, ensuring a clean, finished appearance for the connecting edges and a connection having the same physical and structural integrity as the connections between adjacent wall panel units. The door frame panel itself is particularly configured to receive a traditional, commercially available steel door frame and door assembly, but allows fitment of such commercially available steel door frame and door assembly without cutting a wall panel to receive that frame.

In accordance with certain aspects of an embodiment of the invention, an interlocking door frame panel and wall panel system for modular building units is disclosed, comprising: a plurality of wall panels of identical construction, each wall panel further comprising: an external sheet and an internal sheet; a vertical tongue extending along a first vertical edge of the wall panel and formed by a first edge of each of the external sheet and the internal sheet; a vertical groove extending along a second vertical edge of the wall panel and formed by a second edge of each of the external sheet and the internal sheet, wherein the vertical groove of a first panel is configured to mate with the vertical tongue of an adjacent panel to form a connected edge in which the external sheets of adjacent panels are in contact and coplanar with one another, and the internal sheets of adjacent panels are in contact and coplanar with one another; and at least one door panel comprising: a first vertical door panel frame member forming a vertical tongue extending along a first vertical edge of the door panel, the first vertical door panel frame member being configured to mate with a vertical groove of a second adjacent wall panel to form a connected edge in which the external sheet of the second adjacent wall panel is in contact and coplanar with an external side of the first vertical door panel frame member, and the internal sheet of the second adjacent wall panel is in contact and coplanar with an internal side of the first vertical door panel frame member; and a second vertical door panel frame member forming a vertical groove extending along a second vertical edge of the door panel, the second vertical door panel frame member being configured to mate with a vertical tongue of a third adjacent wall panel to form a connected edge in which the external sheet of the third adjacent wall panel is in contact and coplanar with an external side of the second vertical door panel frame member, and the internal sheet of the third adjacent wall panel is in contact and coplanar with an internal side of the second vertical door panel frame member.

In accordance with further aspects of an embodiment of the invention, a modular building unit is disclosed comprising: a rigid, fixed modular building unit frame having a plurality of corner support posts, a bottom rail extending between adjacent pairs of corner support posts, a top rail extending between adjacent pairs of corner support posts, a plurality of wall panels extending between the corner support posts, the top rails, and the bottom rails, and at least one door panel extending between one of the top rails and one of the bottom rails; wherein each wall panel further comprises: an external sheet and an internal sheet; a vertical tongue extending along a first vertical edge of the wall panel and formed by a first edge of each of the external sheet and the internal sheet; a vertical groove extending along a second vertical edge of the wall panel and formed by a second edge of each of the external sheet and the internal sheet, wherein the vertical groove of a first panel is configured to mate with the vertical tongue of an adjacent panel to form a connected edge in which the external sheets of adjacent panels are in contact and coplanar with one another, and the internal sheets of adjacent panels are in contact and coplanar with one another; and wherein the door panel further comprises: a first vertical door panel frame member forming a vertical tongue extending along a first vertical edge of the door panel, the first vertical door panel frame member being configured to mate with a vertical groove of a second adjacent wall panel to form a connected edge in which the external sheet of the second adjacent wall panel is in contact and coplanar with an external side of the first vertical door panel frame member, and the internal sheet of the second adjacent wall panel is in contact and coplanar with an internal side of the first vertical door panel frame member; and a second vertical door panel frame member forming a vertical groove extending along a second vertical edge of the door panel, the second vertical door panel frame member being configured to mate with a vertical tongue of a third adjacent wall panel to form a connected edge in which the external sheet of the third adjacent wall panel is in contact and coplanar with an external side of the second vertical door panel frame member, and the internal sheet of the third adjacent wall panel is in contact and coplanar with an internal side of the second vertical door panel frame member.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
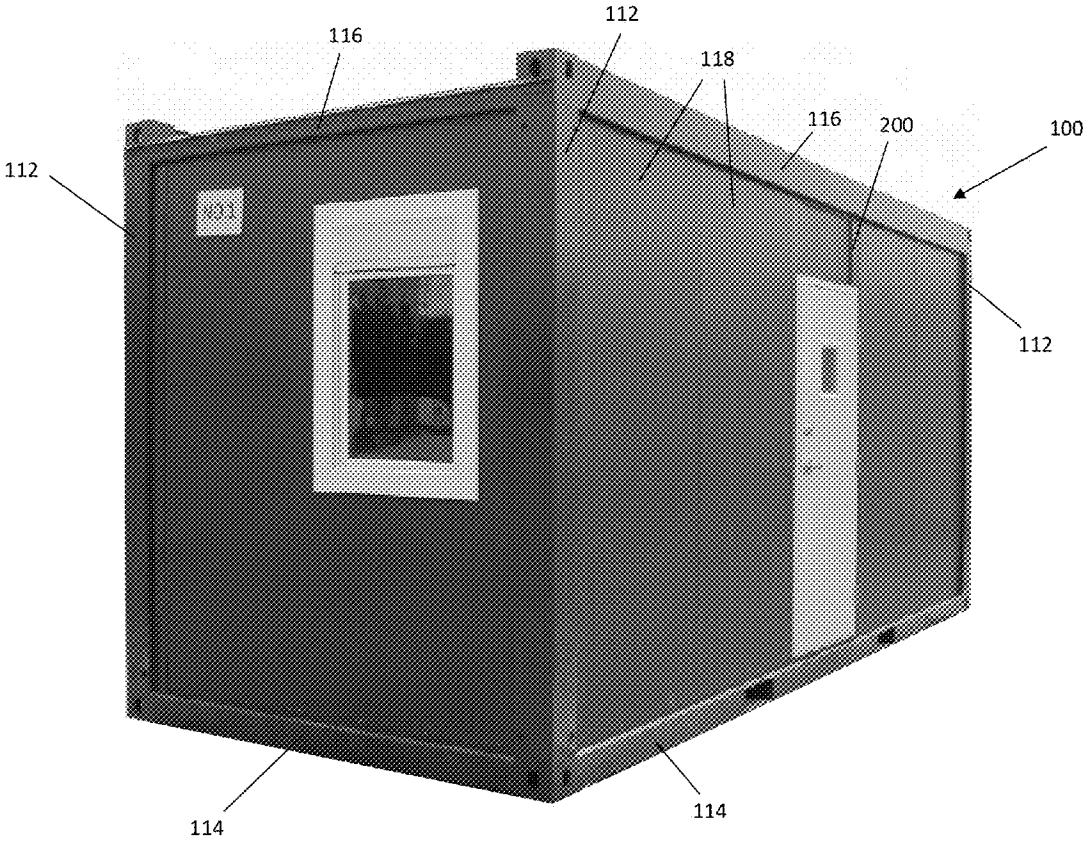
FIG. 1 is a perspective view of a modular building unit in accordance with certain aspects of an embodiment of the invention.

FIG. 1 provides a perspective view of a modular building unit 100 in accordance with certain aspects of an embodiment of the invention. Modular building unit 100 includes a skeletal frame formed by corner support posts 112, bottom rails 114, and top rails 116, wall panels 118, windows 120, and door panels 200. This skeletal frame provides the key structural integrity for the modular building unit. As shown in FIG. 1, wall panels 118 are positioned between corner support posts 112, bottom rails 114, and top rails 116, which wall panels 118 form the wall structures spanning each side of the modular building unit.

Figure 2:
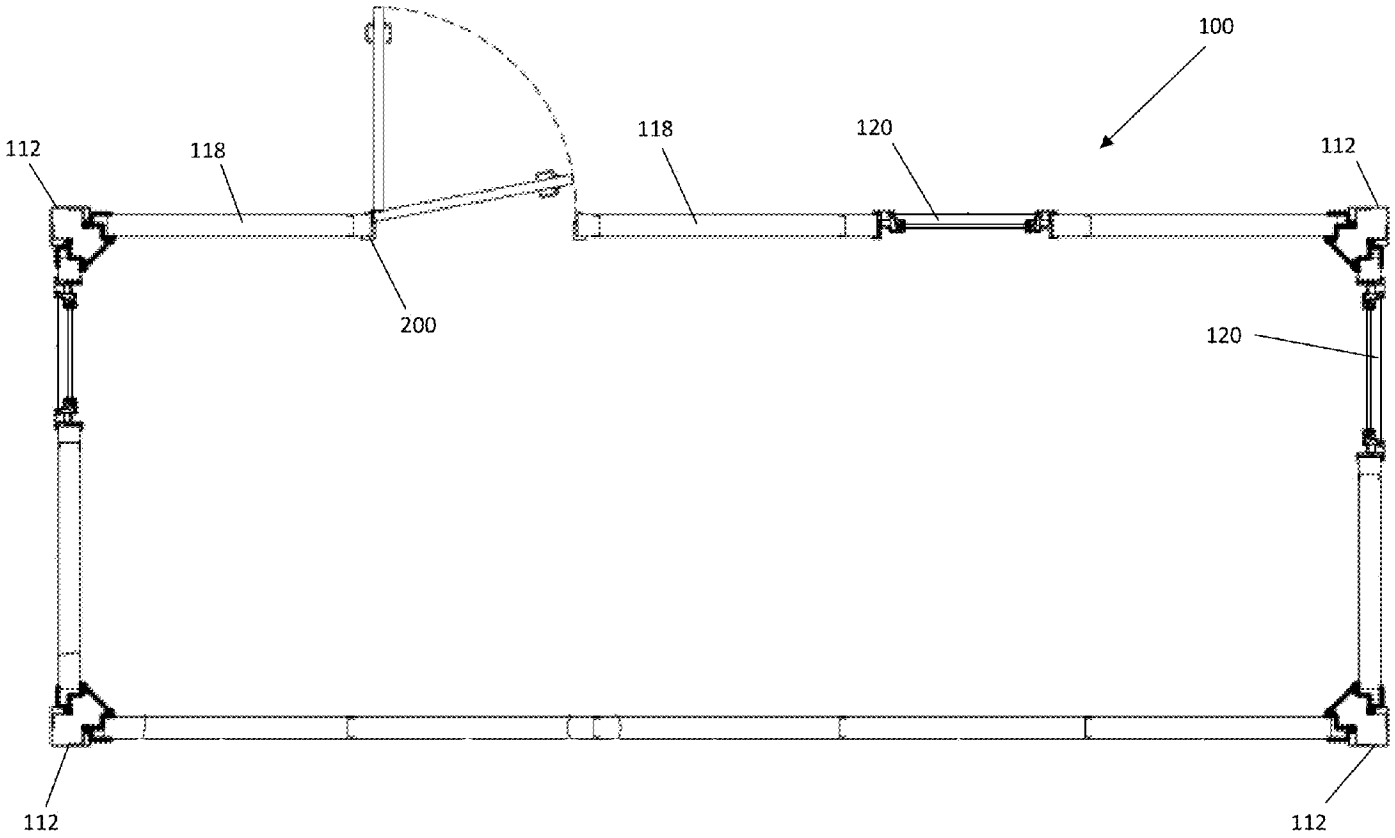
FIG. 2 is a top down, sectional view of an exemplary configuration of the modular building unit of FIG. 1.
Figure 3:
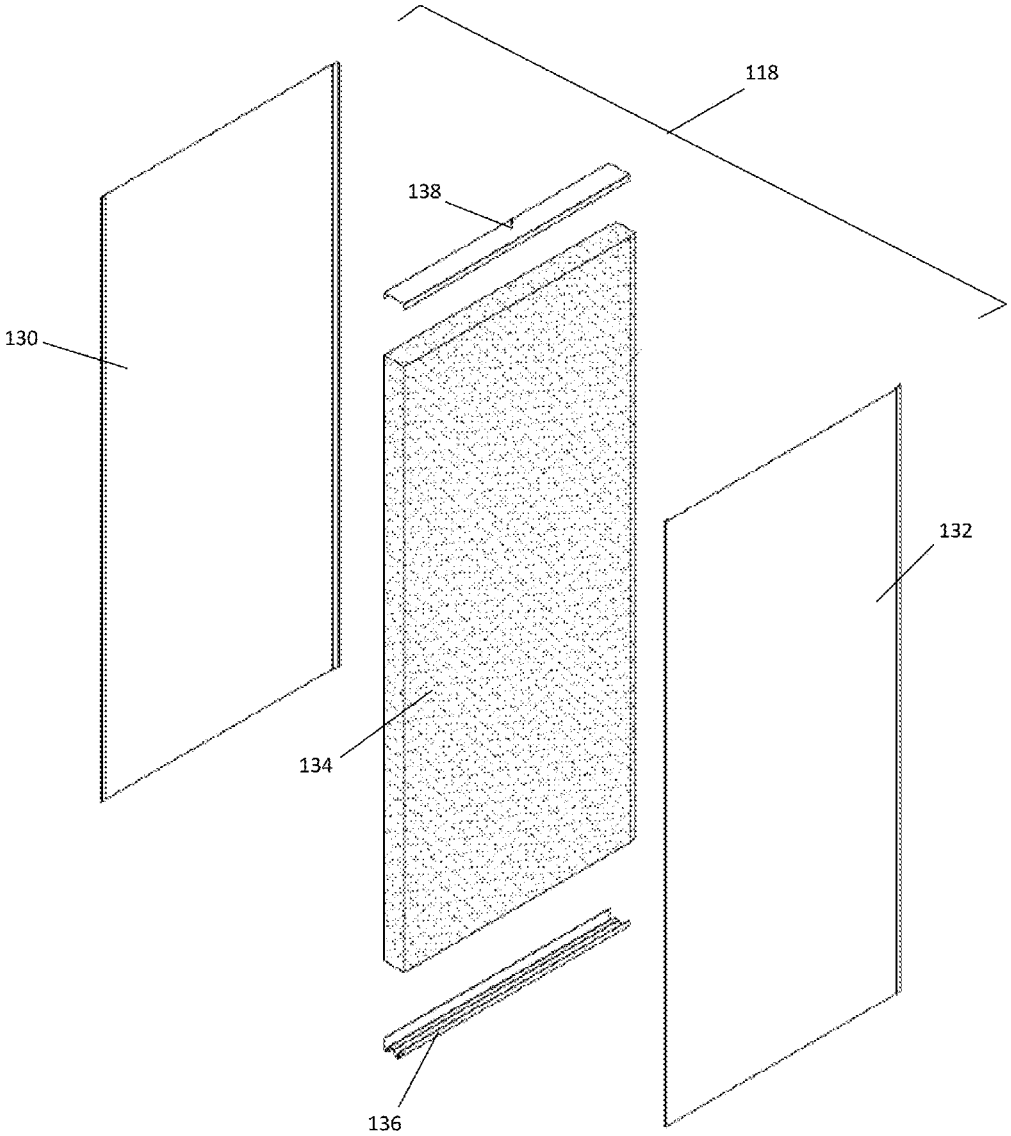
FIG. 3 is an exploded view of a wall panel for use with modular building unit of FIG. 1.

FIG. 2 is a top down, sectional view of the modular building unit 100. As shown in FIG. 2, wall panels 118 are joined to one another, and to both corner brackets 112 and door panel 200, by edge profiles, the construction of which is described in detail below. With continued reference to FIG. 2 and to the exploded view of a wall panel 118 of FIG. 3, each wall panel 118 is comprised of an external sheet 130 which forms the exterior wall surface of the modular building unit 100, an internal sheet 132 which forms the interior wall surface of the modular building unit 100, and an insulation panel 134 positioned between external sheet 130 and internal sheet 132 providing added rigidity to each wall panel 118, in addition to thermal insulation for the modular building unit 100. With particular reference to FIG. 3, wall panels 118 also include a bottom profile 136 for joining wall panel 118 to bottom rails 114 of the frame of the modular building unit 100, and a top profile 138 for joining wall panel 118 to top rails 116 of the frame of the modular building unit 100.

Figure 4:
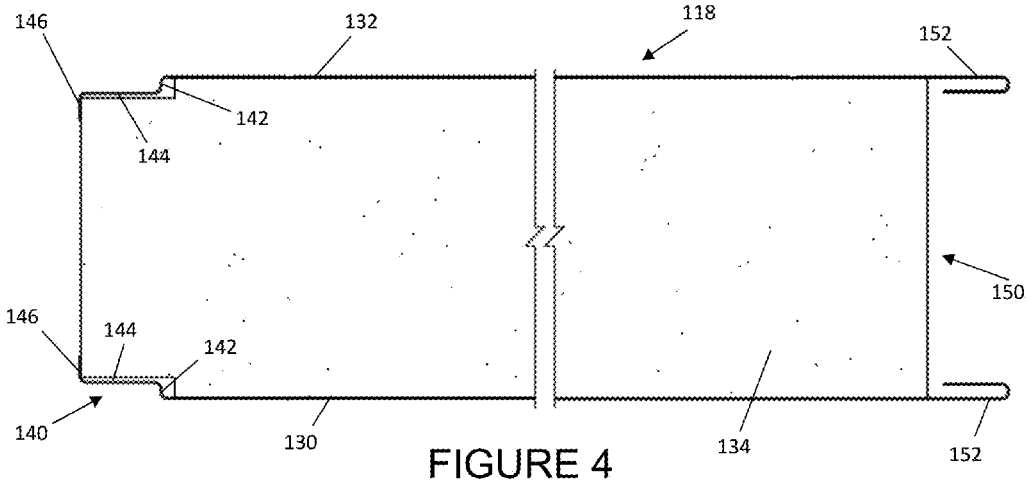
FIG. 4 is a top down, cross-sectional view of an assembled wall panel of FIG. 3.

FIG. 4 provides a top down, cross-sectional view of an assembled wall panel 118. Each wall panel 118 has a first side edge comprising a male profile 140, and a second, opposite side edge comprising a female profile 150. Male profile 140 is configured to engage with female profile 150 on an adjacent wall panel 118 in a tongue-and-groove mating connection. Male profile 140 extends from both external sheet 130 and internal sheet 132, and includes an inwardly bent leg 142 and a tongue wall 144 extending outward from leg 142 in a direction generally parallel to each of external sheet 130 and internal sheet 132 so as to form a sidewall of the tongue of male profile 140. An inwardly extending flange 146 may also be provided extending inward from tongue wall 144. Insulation panel 134 preferably has a complementary male profile adjacent male profile 140, such that inwardly extending flanges 146 may overlap the edge of insulation panel 134. Likewise, female profile 150 extends from the opposite ends of both external sheet 130 and internal sheet 132 so as to form sidewalls of female profile 150, and is defined by two u-shaped end walls 152. Each u-shaped end wall 152 is sized to fit within the open space between tongue wall 144 and the outer wall of the respective inner and outer sheet 130 and 132.

Figure 5:
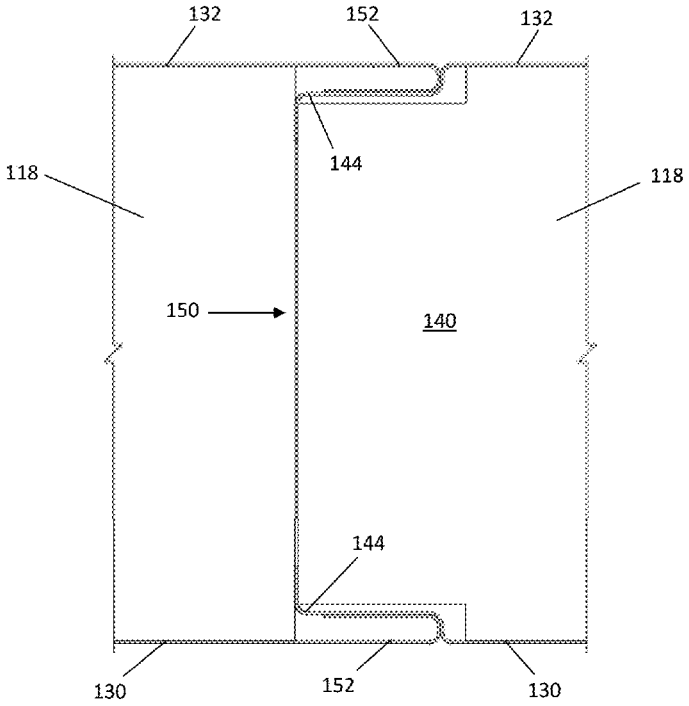
FIG. 5 is a top view of the joining of two mated wall panels of FIG. 4.

FIG. 5 shows two such wall panels 118 mated together with the male profile 140 of the panel on the right in FIG. 5 engaging the female profile 150 of the wall panel on the left in FIG. 5. As shown in FIG. 5, the interior face of u-shaped end wall 152 sits flush against the exterior face of tongue wall 144 of the adjacent panel, such that the outer faces of adjacent external sheets 130 and internal sheets 132 are aligned.

Figure 6:
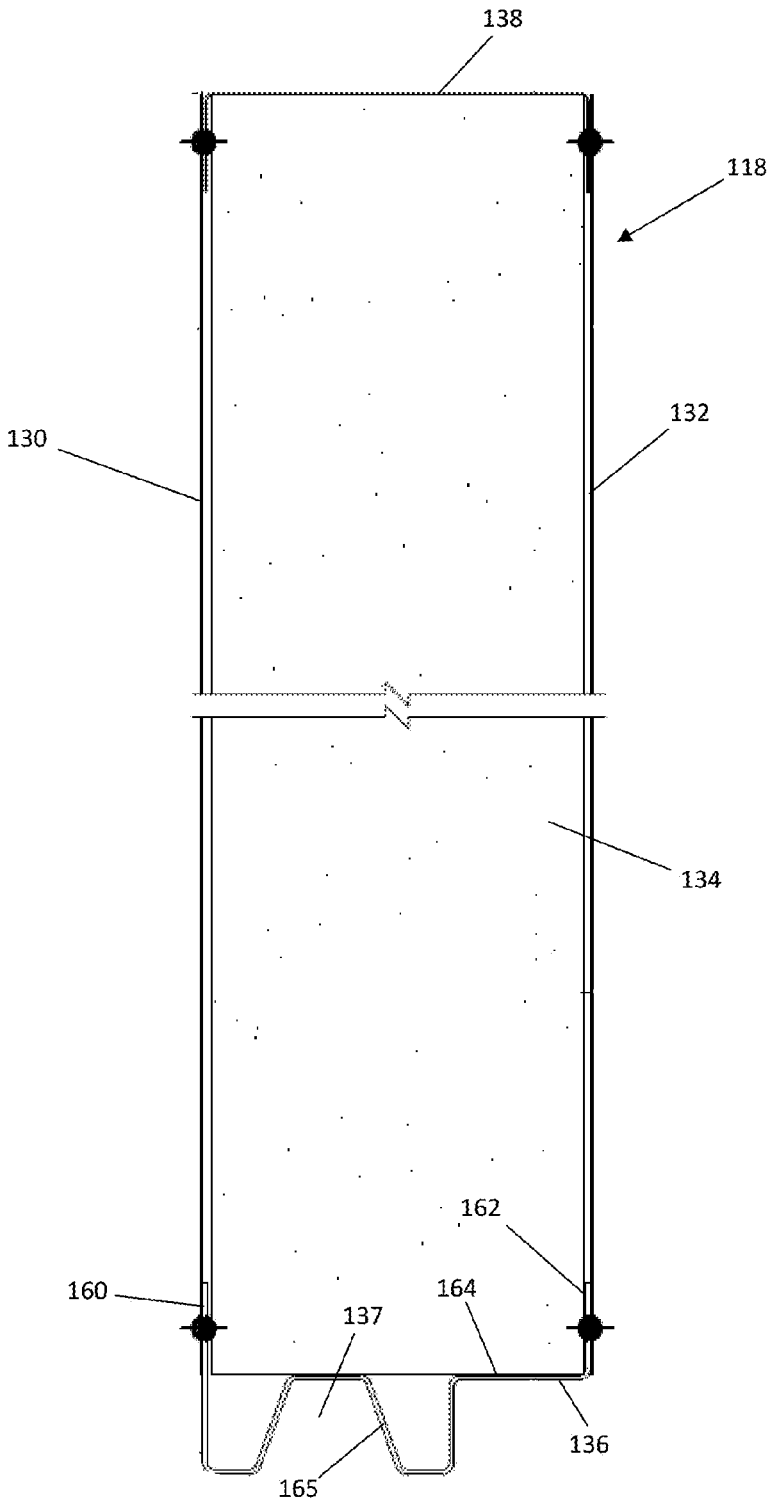
FIG. 6 is a side view the wall panel of FIG. 4.

FIG. 6 shows a side view of wall panel 118, again including external sheet 130 shown on the left side of FIG. 6 and internal sheet 132 shown on the right side of FIG. 6, with insulation panel 134 positioned between them. Likewise, a bottom wall panel profile 136 is provided closing the bottom of wall panel 118, and a top wall panel profile 138 is provided closing the top of wall panel 118.

With continued reference to FIG. 6, bottom wall panel profile 136 includes a front wall 160 having a top portion that is positioned between external sheet 130 and insulation panel 134, and a lower portion extending downward from the bottom of external sheet 130. Bottom wall panel profile 136 likewise includes a back wall 162 extending between internal sheet 132 and insulation panel 134. An internal ledge 164 extends outward from back wall 162 and sits adjacent to and supports a bottom edge of insulation panel 134. Further, a bottom rail engaging extension 165 forms a notch 137 configured to receive a ridge 115 on bottom rail 114, as discussed in greater detail below with respect to FIG. 7.

Likewise, with reference to both FIGS. 3 and 6, top wall panel profile 138 is comprised of a planar top wall and downwardly extending sidewalls that are positioned between insulation panel 134 and each of external sheet 130 and internal sheet 132. This top wall panel profile provides a block structure that may be inserted into an open, generally rectangular space formed at the top of the frame, as discussed below with regard to FIG. 7.

Figure 7:
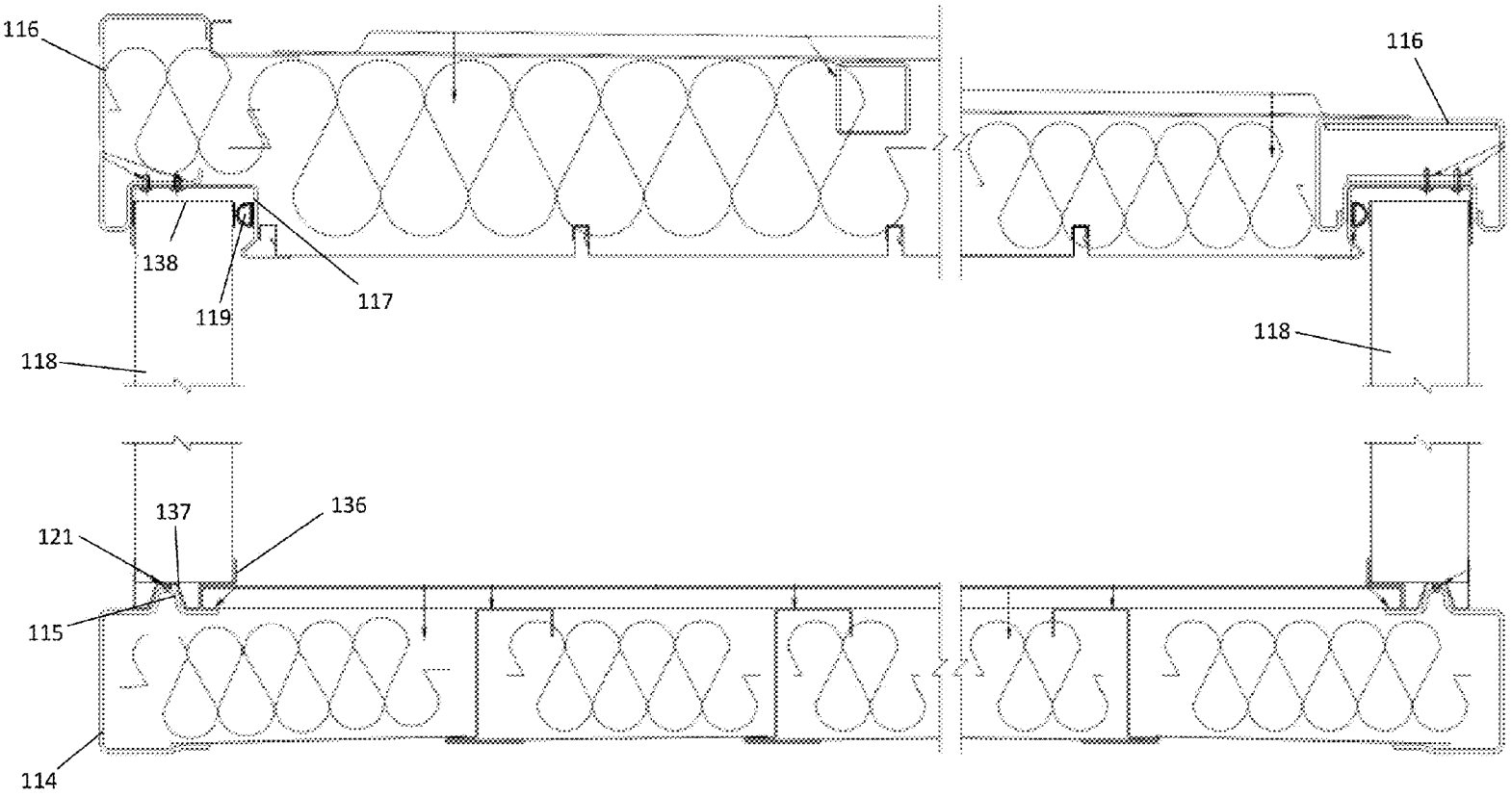
FIG. 7 is a cross-sectional view of wall panels of FIG. 4 installed on the frame of the modular building unit of FIG. 1.

FIG. 7 shows a cross-sectional view of wall panels 118 installed on the frame of the modular building unit 100. As shown in FIG. 7, a ceiling tray end bracket 117 is attached to the bottom side of top rail 116, and defines a rectangular opening that receives the top of wall panel 118 and top profile 138. Top rail 116 and ceiling tray end bracket 117 are positioned such that when a wall panel 118 is positioned within the frame of the modular building unit 100, an open space exists between the top of wall panel 118 and the bottom surface of ceiling tray end bracket 117. A rubber gasket 119 may be provided between the back, top edge of wall panel 118 and ceiling tray end bracket 117 to provide a seal against, for example, water infiltration. Likewise and as mentioned briefly above, a ridge 115 extends upward from a top side of bottom rail 114, which ridge 115 is configured to mate with notch 137 on bottom profile 136 of wall panel 118. Likewise, a rubber gasket 121 may be provided between notch 137 and ridge 115 to provide additional sealing of the wall assembly. When so joined, ridge 115 and notch 137 serve to hold the bottom of wall panel 118 in place on the frame of the modular building unit 100. Nonetheless, such connection allows removal and adjustment of the wall panels 118 within the frame. More particularly, the space provided between the top of the wall panel 118 and the ceiling tray end bracket 117 allows panel 118 to be lifted so that the bottom profile 136 of wall panel 118 may clear ridge 115 on bottom rail 114, such that the bottom of the panel 118 may be pulled outward and the entire panel moved or removed from the modular building unit.

Figure 8:
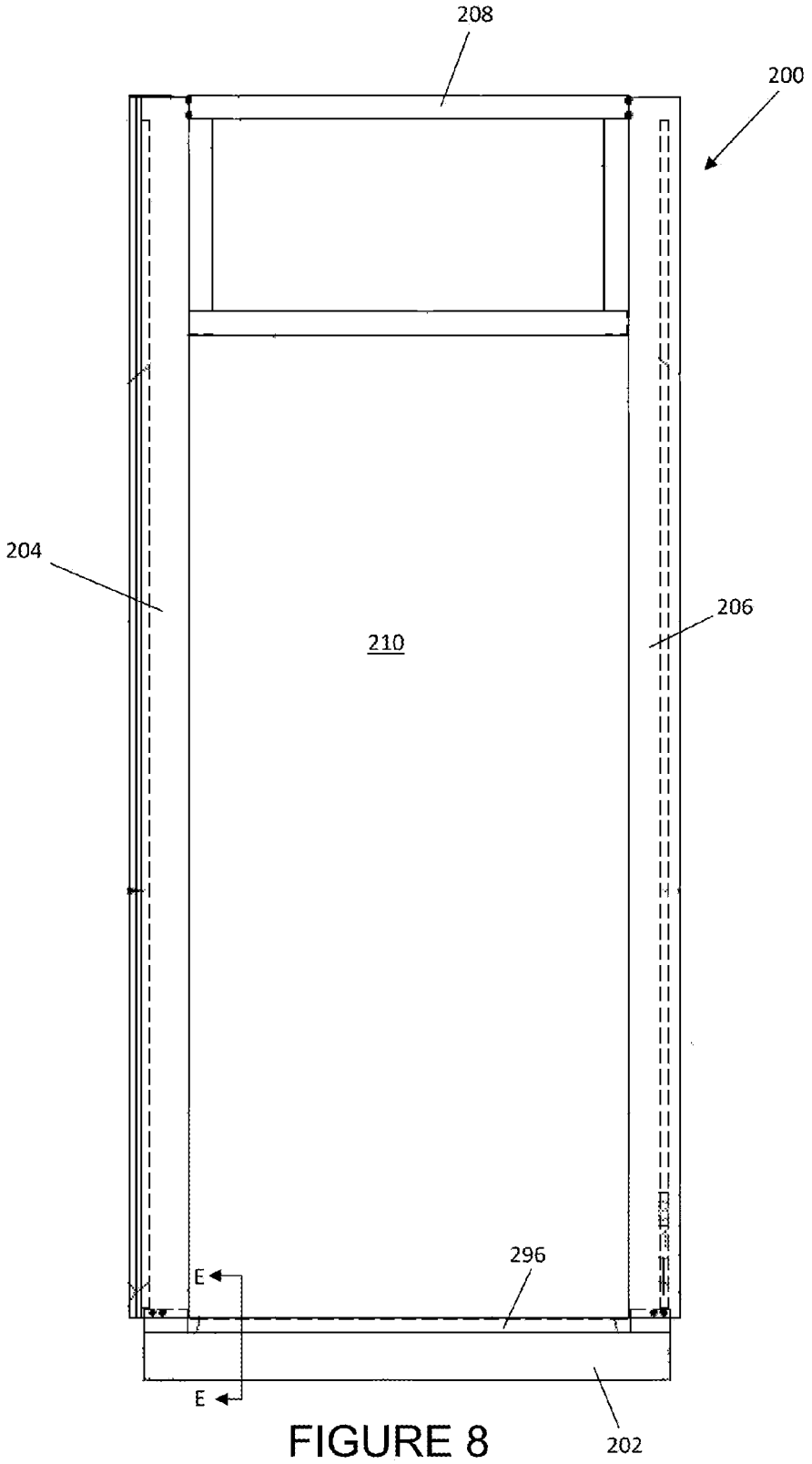
FIG. 8 is a front view of a door panel 200 (shown without the commercially available door and door frame assembly) for use with the modular building unit of FIG. 1.

Next, FIG. 8 provides a front view of a door panel 200 (shown without a commercially available door and door frame assembly for clarity) for use with the modular building unit 100 of FIG. 1. An important feature of the instant invention is that, as described further below, door panel 200 is provided side edge profiles having male and female connection profiles that mate with the male and female profiles 140 and 150, respectively, described above with respect to wall panels 118. This configuration allows ready placement of door panel 200 anywhere as may be desired within the frame of the modular building unit 100, as it may mate with any other wall panels within the frame. Likewise, door panel 200 is provided a top profile and a bottom profile that connect to the top and bottom portions of the frame in the same manner as wall panels 118, such that no specialized modification or construction is required in order to fit a door panel and its associated door and door frame into the modular building unit 100.

Door panel 200 includes a door panel bottom profile 202 similar in configuration to wall panel bottom profile 136 and having a notch identical to notch 137 in wall panel bottom profile 136. Likewise, door panel 200 includes a door panel male profile 204 matching the mating configuration of male profile 140 of wall panel 118, and a door panel female profile 206 matching the mating configuration of female profile 150 of wall panel 118. Thus, door panel male profile 204 has an edge profile configured for mating connection with wall panel female profile 150, and door panel female profile 206 has an edge profile configured for mating connection with wall panel male profile 140. Door panel 200 also includes a door panel top profile 208 having a rectangular exterior perimeter of substantially the same configuration as wall panel top profile 138.

In order to allow fitment of a standard size, commercially available door and door frame, which typically will be of a height dimension that is smaller than the full height dimension of a wall panel 118, a transom assembly is provided in door panel 200, such that the bottom of the transom, along with the interior edges of door panel male profile 204, door panel female profile 206, and door panel bottom profile 202 define a door opening 210 configured to receive a standard door and door frame.

Figure 9:
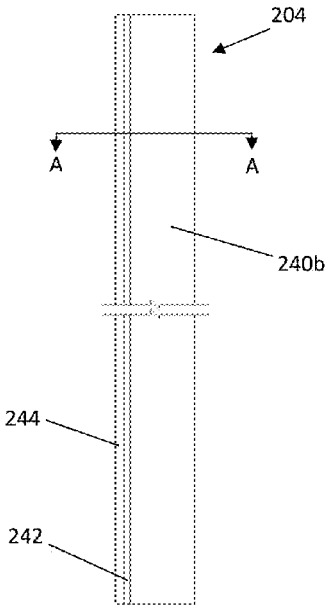
FIG. 9 is a front view of a door panel male edge connecting profile.
Figure 10:
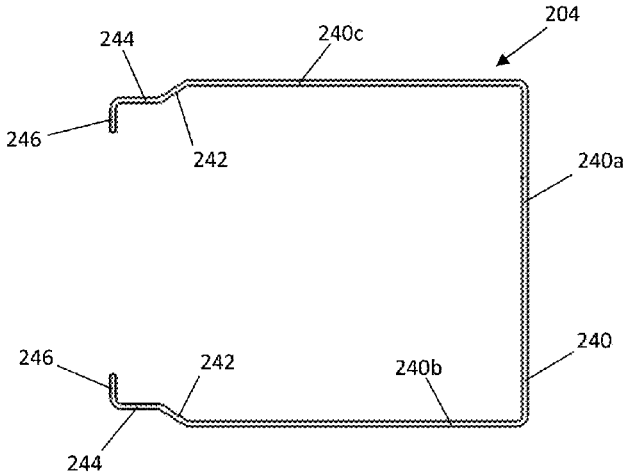
FIG. 10 is a cross-sectional view of the door panel male edge connecting profile of FIG. 9 along section line A-A of FIG. 9.

FIG. 9 provides a front view of door panel male profile 204, and FIG. 10 provides a cross-sectional view of door panel male profile 204 along section line A-A of FIG. 9. As shown in FIGS. 9 and 10, door panel male profile 204 comprises a single, one piece male profile bracket 240. Bracket 240 has a side wall portion **240*a* forming an interior vertical wall of door opening 210, external planar wall portion 240*b* forming an external surface of door panel 200, and internal planar wall portion 240*c* forming an internal surface of door panel 200. Inwardly bent leg 242 extends inward from the ends of each of external planar wall portion 240*b* and internal planar wall portion 240*c*, and a tongue wall 244 extends outward from each inwardly bent leg 242 in a direction generally parallel to external planar wall portion 240*b* and internal planar wall portion 240*c*. Each tongue wall 244 may likewise include an inwardly extending flange 246. This configuration closely mirrors the male profile 140 of wall panel 118, and is sized to receive u-shape end walls 152 of female profile 150 of wall panel 118**.

Figure 11:
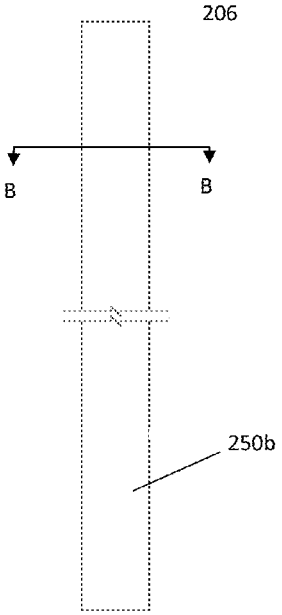
FIG. 11 is a front view of a door panel female edge connecting profile.
Figure 12:
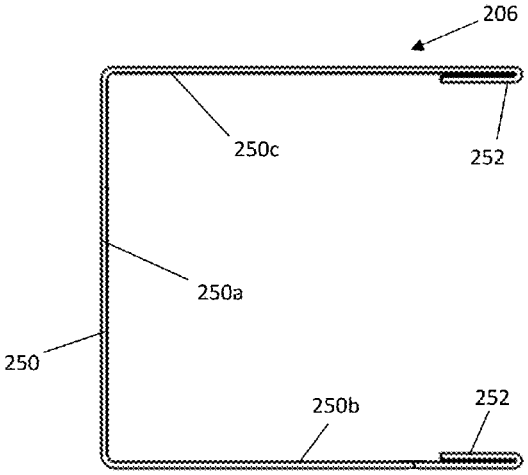
FIG. 12 is a cross-sectional view of the door panel female edge connecting profile of FIG. 11 along section line B-B of FIG. 11.

Likewise, FIG. 11 provides a front view of door panel female profile 206, and FIG. 12 provides a cross-sectional view of door panel female profile 206 along section line B-B of FIG. 11. As shown in FIGS. 11 and 12, door panel female profile 206 comprises a single, one piece female profile bracket 250. Bracket 250 has a side wall portion 250*a* forming an interior vertical wall of door opening 210, external planar wall portion 250*b* forming an external surface of door panel 200, and internal planar wall portion 250*c* forming an internal surface of door panel 200. U-shaped end walls 252 are positioned at the distal ends of each of external planar wall portion 250*b* and internal planar wall portion 250*c*, and are sized to fit within the open space between the tongue wall 144 and the outer wall of respective inner and outer sheets 130 and 132 of a wall panel 118.

Figure 13:
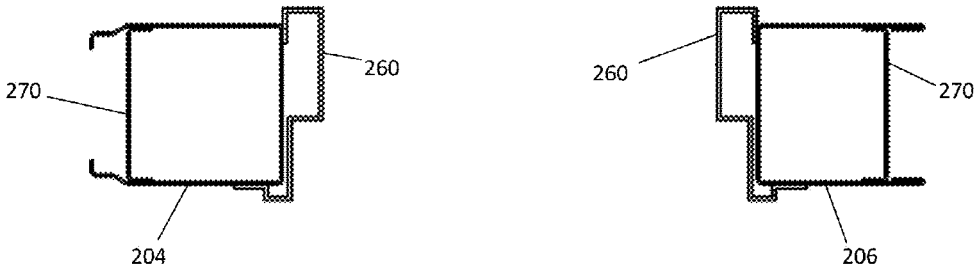
FIG. 13 is a cross-sectional view of the door panel male edge connecting profile and female edge connecting profile with an installed commercially available door frame.

FIG. 13 is a cross-sectional view of door panel male profile 204 and door panel female profile 206 with an installed door frame 260, such as a traditional door frame include a door stop and hinges for mounting a standard door (not shown), which door frame 260 extends from the door panel bottom profile 202 to the bottom of the transom assembly at the top of door panel 200. Further, a reinforcement member 270 may be provided inside of the open ends of each of door panel male profile 204 and door panel female profile 206 to provide additional structural rigidity to each of profiles 204 and 206. Reinforcement member 270 has a facing wall spanning the opening between opposing outer planar wall portions of each of door panel male profile 204 and door panel female profile 206, and side walls for engagement with and attachment to the interior faces of those planar wall portions. Reinforcement member 270 thus forms an open space within the interior of each of door panel male profile 204 and door panel female profile 206, which open space may optionally receive insulation to provide an additional thermal barrier to the interior of modular building 100.

Figure 14:
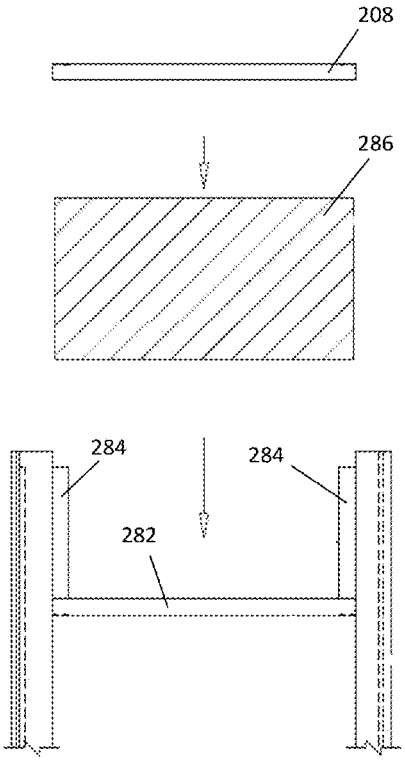
FIG. 14 is an exploded view of a transom assembly for use with the door panel of FIG. 8.

FIG. 14 provides an exploded view of the transom assembly at the top of door panel 200. The transom assembly is formed by door panel top profile 208, transom lower cross member 282, and transom side members 284. Each of door panel top profile 208, transom lower cross member 282, and transom side members 284 are preferably formed from u-shaped channels as discussed further below with regard to FIG. 15. Further, a solid transom panel 286 may be provided to fill the open space formed by door panel top profile 208, transom lower cross member 282, and transom side members 284 to fully close the door panel structure. Solid transom panel 286 may be formed of foam, a steel plate, a glass window, or any other structure as may be suitable for a particular installation.

Figure 15:
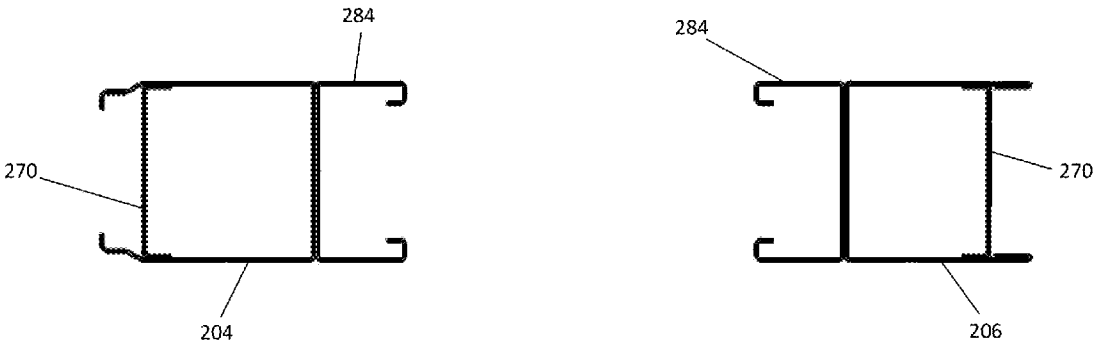
FIG. 15 is a cross-sectional view of the door panel male edge connecting profile of FIG. 9 and the female edge connecting profile of FIG. 11 with attached transom side members.

FIG. 15 provides a cross-sectional view of door panel male profile 204 and female profile 206 with attached transom side members 284. The legs of each u-shaped transom side member 284, as well as the legs of u-shaped door panel top profile 208 and u-shaped transom lower cross member 282, are each provided an inwardly directed hook portion at their respective distal ends, the interiors of which form an opening for receiving and holding transom panel 286 in place.

Figure 16:
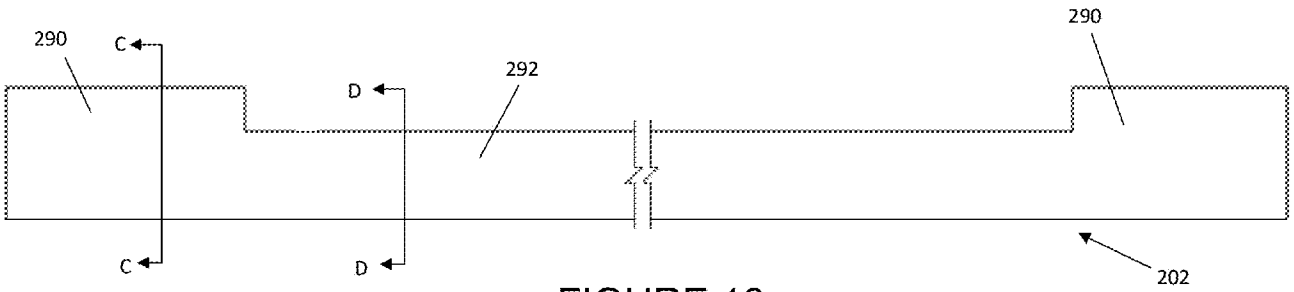
FIG. 16 is a front view of a door panel bottom profile for use with the door panel of FIG. 8.

Further and again as mentioned above, door panel 200 includes door panel bottom profile 202 configured for attachment to bottom rails 114 in the same manner as bottom profile 136 of wall panels 118. FIG. 16 provides a front view of door panel bottom profile 202, and comprises end portions 290 and a mid-section 292 extending between the two end portions 290. Mid-section 292 is vertically aligned with door opening 210.

Figure 18:
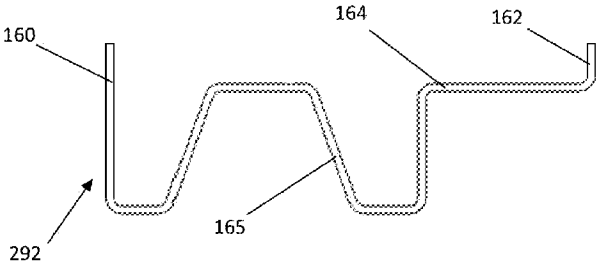
FIG. 18 is a cross-sectional view of the bottom profile along section line D-D of FIG. 16.
Figure 17:
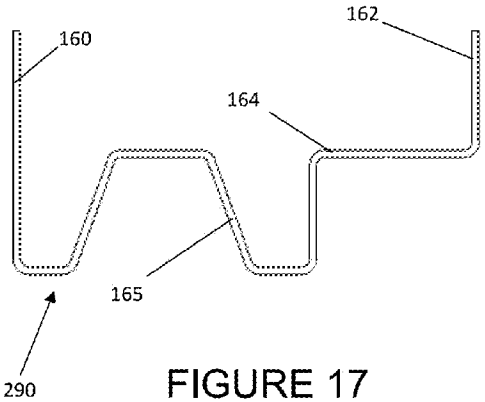
FIG. 17 is a cross-sectional view of the bottom profile along section line C-C of FIG. 16.
Figure 19:
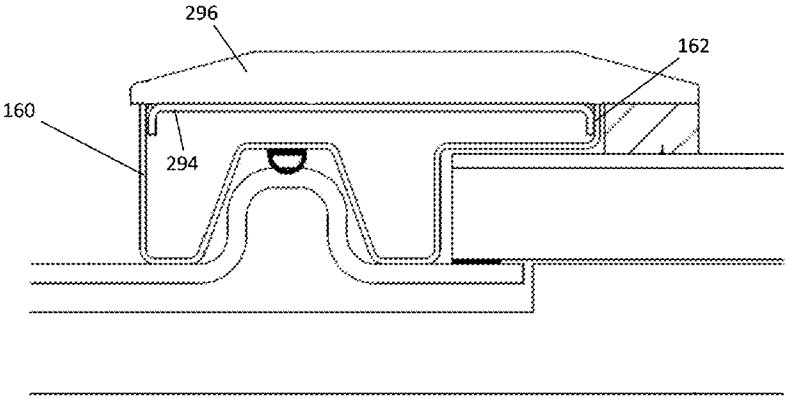
FIG. 19 is a cross-sectional view of the door panel along section line E-E of FIG. 8.

FIG. 17 is a cross-sectional view of end portion 290 of door panel bottom profile 202 along section line C-C of FIG. 16, and FIG. 18 is a cross-sectional view of mid-section 292 of door panel bottom profile 202 along section line D-D of FIG. 16. Each of end portions 290 and mid-section 292 comprise the same segments as wall panel bottom profile 136, including a front wall 160, back wall 162, internal ledge 164, and bottom rail-engaging extension 165 forming notch 137. The difference between end portions 290 and mid-section 292 resides in the height of front wall 160 and back wall 162; namely, mid-section 292 is shortened in height from end portions 290. As shown in the cross-sectional view of door panel 200 of FIG. 19 (along section line E-E of FIG. 8), by providing mid-section 292 with a shortened height dimension from the end portions 290, door panel bottom profile 202 may accommodate a door stop 296. A door frame floor insert 294 is positioned within front wall 160 and back wall 162 of the mid-section 292 of door panel bottom profile 202, such that door stop 296 (of conventional configuration) may be positioned overtop of and affixed to door frame floor insert 294.

The foregoing configuration results in a modular building construction having interlocking wall panels that mate with one another and with a door panel in the same manner, thus providing a common configuration for joining panels regardless of whether or not they serve as a wall panel or are fitted with a door. While the door panels are specially and modularly configured to receive a full, traditional, commercially available door and door frame assembly, the door frame that receives such commercially available door and door frame assembly is readily fitted into any position around the perimeter of the modular building unit, and can readily be moved, removed, or adjusted as necessary given the common configuration of mating edges between both wall panels and the door panel. This significantly simplifies installation of doors and door frames and maintains a uniform appearance at panel edges, avoids the problems experienced by traditional door installations for modular buildings that have required cutting a hole in a wall panel to fit a door and door frame into a desired spot, and provides a structurally reinforced door assembly in a flexible-use frame without requiring the investment in aluminum profile tooling required for expensive, custom door assemblies.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. An interlocking door frame panel and wall panel system for modular building units, comprising:

a plurality of wall panels of identical construction, each said wall panel further comprising:

an external sheet and an internal sheet;

a vertical tongue extending along a first vertical edge of said wall panel and formed by a first edge of each of said external sheet and said internal sheet, said vertical tongue further comprising a first inwardly bent leg bending toward an interior of said wall panel at a first side edge of the external sheet and an external side tongue wall extending outward from an end of said leg, and a second inwardly bent leg bending toward an interior of said wall panel at a first side edge of the internal sheet and an internal side tongue wall extending outward from an end of said second leg;

a vertical groove extending along a second vertical edge of said wall panel and formed by a second edge of each of said external sheet and said internal sheet, wherein said vertical groove of a first one of the wall panels is configured to mate with said vertical tongue of an adjacent one of the wall panels to form a connected edge in which said external sheets of adjacent wall panels are in contact and coplanar with one another, and said internal sheets of adjacent wall panels are in contact and coplanar with one another; and at least one door panel comprising:

a first vertical door panel frame member forming a vertical tongue extending along a first vertical edge of said door panel, said first vertical door panel frame member being configured to mate with a vertical groove of a second adjacent one of the wall panels to form a connected edge in which said external sheet of said second adjacent one of the wall panels is in contact and coplanar with an external side of said first vertical door panel frame member, and said internal sheet of said second adjacent one of the wall panels is in contact and coplanar with an internal side of said first vertical door panel frame member, wherein said first vertical door panel frame member further comprises an external face, an internal face, and a vertical interior wall extending between and perpendicular to said external face and said internal face of said first vertical door panel frame member; and a second vertical door panel frame member forming a vertical groove extending along a second vertical edge of said door panel, said second vertical door panel frame member being configured to mate with a vertical tongue of a third adjacent one of the wall panels to form a connected edge in which said external sheet of said third adjacent one of the wall panels is in contact and coplanar with an external side of said second vertical door panel frame member, and said internal sheet of said third adjacent one of the wall panels is in contact and coplanar with an internal side of said second vertical door panel frame member, wherein said second vertical door frame member further comprises an external face, an internal face, and a vertical interior wall extending between and perpendicular to said external face and said internal face of said second vertical door panel frame member.

2. The interlocking door frame panel and wall panel system of claim 1, said vertical groove of each said wall panel further comprising:

an external groove wall extending outward from a second side edge of the external sheet, said external groove wall having an external face configured to align with the external sheet of an adjacent one of the wall panels, an internal face configured for facing engagement with said external side tongue wall of an adjacent one of the wall panels, and a rounded end portion configured to abut said first inwardly bent leg of an adjacent one of the wall panels; and an internal groove wall extending outward from a second side edge of the internal sheet, said internal groove wall having an external face configured to align with the internal sheet of an adjacent one of the wall panels, an internal face configured for facing engagement with said internal side tongue wall of an adjacent one of the wall panels, and a rounded end portion configured to abut said second inwardly bent leg of an adjacent one of the wall panels.

3. The interlocking door frame panel and wall panel system of claim 1, further comprising a door and door frame assembly mounted to said vertical interior wall of said first vertical door panel frame member and said vertical interior wall of said second vertical door panel frame member.

4. The interlocking door frame panel and wall panel system of claim 1, said first vertical door panel frame member further comprising a reinforcement member extending between and perpendicular to said external face and said internal face of said first vertical door panel frame member and positioned adjacent said vertical tongue of said first vertical door panel frame member.

5. The interlocking door frame panel and wall panel system of claim 4, said second vertical door panel frame member further comprising a reinforcement member extending between and perpendicular to said external face and said internal face of said second vertical door panel frame member and positioned adjacent said vertical groove of said second vertical door panel frame member.

6. The interlocking door frame panel and wall panel system of claim 1, said door panel further comprising:

a top profile extending between said first vertical door panel frame member and said second vertical door panel frame member; and a transom at a top portion of said door panel, said transom further comprising:

a first transom side member affixed to an interior face of said first vertical door panel frame member;

a second transom side member affixed to an interior face of said second vertical door panel frame member;

a transom lower cross member extending between said first vertical door panel frame member and said second vertical door panel frame member; and a transom panel bordered by said first transom side member, said second transom side member, said transom lower cross member, and said top profile of said door panel.

7. The interlocking door frame panel and wall panel system of claim 1, each of said wall panels and said door panel having a top profile defining an outer rectangular perimeter configured to fit within a rectangular opening in an upper frame member of a modular building unit, and a bottom profile having an upwardly extending notch configured to engage an upwardly extending ridge on a lower frame member of a modular building unit.

8. A modular building unit comprising:

a rigid, fixed modular building unit frame having a plurality of corner support posts, a bottom rail extending between adjacent pairs of corner support posts, a top rail extending between adjacent pairs of corner support posts, a plurality of wall panels extending between said corner support posts, said top rails, and said bottom rails, and at least one door panel extending between one of said top rails and one of said bottom rails;

wherein each said wall panel further comprises:

an external sheet and an internal sheet;

a vertical tongue extending along a first vertical edge of said wall panel and formed by a first edge of each of said external sheet and said internal sheet;

a vertical groove extending along a second vertical edge of said wall panel and formed by a second edge of each of said external sheet and said internal sheet, wherein said vertical groove of a first one of the wall panels is configured to mate with said vertical tongue of an adjacent second one of the wall panels to form a connected edge in which said external sheets of said first and second adjacent wall panels are in contact and coplanar with one another, and said internal sheets of said adjacent first and second wall panels are in contact and coplanar with one another; and wherein said door panel further comprises:

a first vertical door panel frame member forming a vertical tongue extending along a first vertical edge of said door panel, said first vertical door panel frame member being configured to mate with a vertical groove of a third adjacent one of the wall panels to form a connected edge in which said external sheet of said third adjacent one of the wall panels is in contact and coplanar with an external side of said first vertical door panel frame member, and said internal sheet of said third adjacent one of the wall panels is in contact and coplanar with an internal side of said first vertical door panel frame member; and a second vertical door panel frame member forming a vertical groove extending along a second vertical edge of said door panel, said second vertical door panel frame member being configured to mate with a vertical tongue of a fourth adjacent one of the wall panels to form a connected edge in which said external sheet of said fourth adjacent one of the wall panels is in contact and coplanar with an external side of said second vertical door panel frame member, and said internal sheet of said fourth adjacent one of the wall panels is in contact and coplanar with an internal side of said second vertical door panel frame member.

9. The modular building unit of claim 8, said vertical tongue of each said wall panel further comprising:

a first inwardly bent leg bending toward an interior of said wall panel at a first side edge of the external sheet and an external side tongue wall extending outward from an end of said leg, and a second inwardly bent leg bending toward an interior of said wall panel at a first side edge of the internal sheet and an internal side tongue wall extending outward from an end of said second leg.

10. The modular building unit of claim 9, said vertical groove of each said wall panel further comprising:

an external groove wall extending outward from a second side edge of the external sheet, said external groove wall having an external face configured to align with the external sheet of an adjacent one of the wall panels, an internal face configured for facing engagement with said external side tongue wall of an adjacent one of the wall panels, and a rounded end portion configured to abut said first inwardly bent leg of an adjacent one of the wall panels; and an internal groove wall extending outward from a second side edge of the internal sheet, said internal groove wall having an external face configured to align with the internal sheet of an adjacent one of the wall panels, an internal face configured for facing engagement with said internal side tongue wall of an adjacent one of the wall panels, and a rounded end portion configured to abut said second inwardly bent leg of an adjacent one of the wall panels.

11. The modular building unit of claim 8, said first vertical door panel frame member further comprising an external face, an internal face, and a vertical interior wall extending between and perpendicular to said external face and said internal face of said first vertical door panel frame member.

12. The modular building unit of claim 11, said second vertical door panel frame member further comprising an external face, an internal face, and a vertical interior wall extending between and perpendicular to said external face and said internal face of said second vertical door panel frame member.

13. The modular building unit of claim 12, further comprising a door and door frame assembly mounted to said vertical interior wall of said first vertical door panel frame member and said vertical interior wall of said second vertical door panel frame member.

14. The modular building unit of claim 12, said first vertical door panel frame member further comprising a reinforcement member extending between and perpendicular to said external face and said internal face of said first vertical door panel frame member and positioned adjacent said vertical tongue of said first vertical door panel frame member.

15. The modular building unit of claim 14, said second vertical door panel frame member further comprising a reinforcement member extending between and perpendicular to said external face and said internal face of said second vertical door panel frame member and positioned adjacent said vertical groove of said second vertical door panel frame member.

16. The modular building unit of claim 8, said door panel further comprising:

a top profile extending between said first vertical door panel frame member and said second vertical door panel frame member; and a transom at a top portion of said door panel, said transom further comprising:

a first transom side member affixed to an interior face of said first vertical door panel frame member;

a second transom side member affixed to an interior face of said second vertical door panel frame member;

a transom lower cross member extending between said first vertical door panel frame member and said second vertical door panel frame member; and a transom panel bordered by said first transom side member, said second transom side member, said transom lower cross member, and said top profile of said door panel.

17. The modular building unit of claim 8, each of said wall panels and said door panel having a top profile defining an outer rectangular perimeter configured to fit within a rectangular opening in one of said top rails, and a bottom profile having an upwardly extending notch configured to engage an upwardly extending ridge on one of said bottom rails.

* * * * *